United States Patent [19]

Schreiber

[11] 4,362,640

[45] Dec. 7, 1982

[54] METHOD FOR RETARDING GELATION OF CRUTCHER SLURRIES CONTAINING BICARBONATE, CARBONATE AND SILICATE

[75] Inventor: Ronald S. Schreiber, Highland Park, N.J.

[73] Assignee: Colgate-Palmolive Company, New York, N.Y.

[21] Appl. No.: 302,528

[22] Filed: Sep. 16, 1981

Related U.S. Application Data

[63] Continuation-in-part of Ser. No. 81,799, Oct. 4, 1979, Pat. No. 4,298,493.

[51] Int. Cl.[3] ..... C11D 7/12; C11D 7/14; C11D 11/02; C11D 17/06

[52] U.S. Cl. ..... 252/135; 252/140; 252/174; 252/174.14; 252/174.21; 252/174.25

[58] Field of Search ..... 252/135, 174, 174.14

[56] References Cited

U.S. PATENT DOCUMENTS

| | | | |
|---|---|---|---|
| 3,886,079 | 5/1975 | Burke | 252/109 |
| 3,886,098 | 5/1975 | DiSalvo | 252/540 |
| 4,264,464 | 4/1981 | Gangwisch | 252/91 |
| 4,294,718 | 10/1981 | Kaeser | 252/135 |
| 4,298,493 | 11/1981 | Schreiber | 252/135 |
| 4,311,606 | 1/1982 | Kaeser | 252/135 |
| 4,311,607 | 1/1982 | Kaeser | 252/140 |

FOREIGN PATENT DOCUMENTS

| | | | |
|---|---|---|---|
| 47-21439 | 6/1972 | Japan | 252/135 |

*Primary Examiner*—Dennis L. Albrecht
*Attorney, Agent, or Firm*—Richard N. Miller; Murray M. Grill; Herbert S. Sylvester

[57] ABSTRACT

Gelation, setting, and solidification of desirably miscible and pumpable aqueous crutcher slurries of sodium carbonate, sodium bicarbonate and sodium silicate are retarded or prevented by admixing of the sodium silicate component of the medium, as an aqueous solution, concurrently with gaseous carbon dioxide, with a slurry of sodium carbonate and sodium bicarbonate in water. During such addition the pH of the slurry is desirably controlled so as to be about 9.9. Although pressurized liquid carbon dioxide is normally employed as a source of the gas, it is within the invention to utilize solid carbon dioxide (dry ice) or liquid carbon dioxide directly, and pieces, particles and droplets thereof may be added to the crutcher mix, wherein they will vaporize quickly. The crutcher slurries may be spray dried and the resulting products are useful as base materials for absorbing nonionic detergent applied to them in liquid state, to produce a particulate heavy duty synthetic organic detergent composition.

12 Claims, No Drawings

METHOD FOR RETARDING GELATION OF CRUTCHER SLURRIES CONTAINING BICARBONATE, CARBONATE AND SILICATE

This application is a continuation-in-part of my U.S. patent application Ser. No. 081,799, filed Oct. 4, 1979, now U.S. Pat. No. 4,298,493.

The present invention relates to preventing or retarding gelation of aqueous slurries containing mixtures of certain inorganic salts, which mixtures otherwise are subject to thickening, gelling and setting. More particularly, the invention is of a method for preventing gelation, excess thickening and setting up of bicarbonate-carbonate-silicate slurries, from which base beads to be employed in the manufacture of particulate heavy duty synthetic organic detergent compositions may be made. In this specification, for simplicity, the terms gelation, gelling and gel will be used but they are intended to denote various thickening, setting and solidification mechanisms and products, even when, technically, actual "gels" may not be involved.

The desirability of being able to produce miscible and pumpable aqueous crutcher slurries of carbonate, bicarbonate and silicate, most preferably as their sodium salts, so that base beads may be made from them by spray drying and so that satisfactory phosphate-free nonionic detergent-based particulate heavy duty synthetic organic detergent compositions may be made from the base beads, has been described in my patent application Ser. No. 081,799, referred to above, which application is hereby incorporated by reference. That application describes the utilization of citric acid as a gelation preventing additive for aqueous crutcher slurries, which permits the commercial manufacture of the mentioned base beads without the dangers of crutcher freeze-ups. In addition to critic acid, magnesium sulfate plus citric acid have also been found to be useful for maintaining crutcher mixes like those described (some of which may also contain zeolite builders) in mobile form during detergent composition manufacturing operations. Although such contributions to the detergent processing art are considered to be significant, the present invention, wherein gaseous carbon dioxide is employed to prevent undesirable gelation when a silicate solution is added to an aqueous crutcher slurry of carbonate and bicarbonate, is also effective for that purpose and possesses advantages not resulting when various other gel preventing additives are employed.

Gaseous carbon dioxide is readily dispersed throughout the crutcher slurry and its gaseous form aids in such dispersal. It is not required that the gas first be dissolved in an aqueous medium, which could result in some dilution of the crutcher mix. The gaseous form prevents possible localized overconcentrations of gel preventing materials in the slurry (and such is a disadvantage of adding dry ice or liquid $CO_2$ to the crutcher). Free alkali in the slurry is satisfactorily neutralized and is converted to a useful builder salt, such as sodium bicarbonate and/or sodium carbonate. Utilization of this gaseous pH controlling means allows for more sensitive pH control and, due to the buffering effect of the resulting slurry, the final pH will not usually quickly change significantly after making of the carbonate-bicarbonate-silicate mixture. Thus, if there is a hold-up in the crutcher the pH will normally remain constant or almost constant, which is desirable to prevent gelation during any such delay. Additionally, the heavier-than-air carbon dioxide "blanket" over the surface of crutcher mix can help to prevent oxidation of any air sensitive adjuvants which may be present in the crutcher slurry.

In accordance with the present invention gelation or setting of a miscible and pumpable crutcher slurry containing a substantial proportion of solids in an aqueous medium, which solids content includes significant proportions of inorganic bicarbonate, carbonate and silicate salts, usually as the sodium salts, is prevented or retarded by admixing of carbon dioxide with such slurry during addition of an aqueous solution of silicate to the aqueous medium containing carbonate and bicarbonate. More particularly, and preferably, a method of retarding or preventing the gelation of a miscible and pumpable crutcher slurry containing from about 40 to 60 or 70% of solids and about 60 to 30 or 40% of water, of which solids content, on a 100% solids basis, 40 to 80% is sodium bicarbonate, 5 to 40% is sodium carbonate and 5 to 25% is sodium silicate of $Na_2O:SiO_2$ ratio within the range of 1:1.6 to 1:3, with the ratio of sodium bicarbonate:sodium carbonate being within the range of 2:1 to 8:1 and the ratio of sodium carbonate:sodium silicate being within the range of 1:3 to 3:1, comprises preparing an aqueous slurry of the sodium bicarbonate and sodium carbonate, and admixing with such aqueous slurry carbon dioxide and an aqueous solution of the sodium silicate. The invention also relates to the combination process which includes making of the described crutcher mix by the invented method and spray drying the resulting slurry to produce particulate base beads, which are suitable for absorption of nonionic detergent to make a free flowing particulate heavy duty synthetic organic detergent product.

It is known that carbon dioxide has been employed as a neutralizing agent in processes in which synthetic organic detergents and detergent compositions have been manufactured. It is also known that various sodium silicate solutions are alkaline in aqueous media and that carbon dioxide reacts with alkali to form bicarbonate. Accordingly, it is not unexpected that reaction could occur between carbon dioxide and aqueous sodium silicate solution. However, it is surprising and unexpectedly beneficial that, by addition of carbon dioxide along with aqueous sodium silicate solution to an aqueous slurry of sodium carbonate and sodium bicarbonate, gelation of such slurry, which might otherwise occur, can be prevented. The present invention is of significance because setting up of such slurries in manufacturing crutchers can shut down commercial detergent production operations while the crutcher is being cleaned out and can cause the waste of additional time in re-starting the entire production line.

While it is considered that the present invention may have application to the making of miscible, flowable and pumpable crutcher slurries of other types than bicarbonate-carbonate-silicate-water mixes, such as slurries also containing synthetic zeolite and/or polyphosphate builder salts, e.g., hydrated Zeolite 4A and/or pentasodium tripolyphosphate, the most significant effects of the gaseous carbon dioxide in preventing or retarding gelation and setting of crutcher slurries is with respect to those containing about 40 to about 60% of solids and about 60 to about 40% of water, with the solids content, on a 100% solids basis, being about 40 to about 80% of sodium bicarbonate, about 5 to about 40% of sodium carbonate and about 5 to about 25% of sodium silicate of $Na_2O:SiO_2$ ratio within the range of 1:1.6 to 1:3. In such compositions the ratio of sodium bicarbonate:sodium carbonate is within the range of about 2:1 to about 8:1 and the ratio of sodium carbonate:sodium silicate is within the range of about 1:3 to about 3:1. The proportion of carbon dioxide will normally be such as to maintain the pH in a desired range and such proportion is considered to be from about 0.1 to about 5% of the total crutcher mix, by weight, preferably from 0.1 to 2%. The pH of the slurry should be maintained within the range of 9.7 to 10.1, preferably 9.8 to 10.0, and more preferably about or at 9.9, by addition of the carbon dioxide, preferably by controlled addition in response to pH determinations, during the addition of the sodium silicate solution. Although co-additions of $CO_2$ and silicate are very much preferred it is within the invention to add some of the $CO_2$ or a source thereof before the silicate.

Preferably, the crutcher slurry contains from 50 to 60 or 65% of solids, with the balance being water, and of the solids content, 50 to 80% is sodium bicarbonate, 10 to 20% is sodium carbonate and 10 to 25% is sodium silicate, with the ratio of sodium bicarbonate:sodium carbonate being within the range of 3:1 to 6:1 and the ratio of sodium carbonate:sodium silicate being within the range of 2:5 to 5:2 or 1:2 to 2:1. More preferably the crutcher slurry contains from 50 to 60% of solids, the balance being water, and of the solids content, 50 to 80% is sodium bicarbonate, 10 to 20% is sodium carbonate and 10 to 25% is sodium silicate, with the bicarbonate:carbonate ratio being within the range of 4:1 to 5:1 and the carbonate:silicate ratio being within the range of 1:1 to 1:2. The components described above, except for water, are normally solid, and the percentages and ratios are on an anhydrous basis, although the materials may be added to the crutcher as hydrates, or dissolved or dispersed in water. Normally, however, the sodium bicarbonate is anhydrous and the sodium carbonate is soda ash. Yet, the carbonate monohydrate may also be employed. The silicate is usually added to the crutcher slurry as an aqueous solution, normally of 40 to 50% solids content, e.g., 47.5% and is preferably added near the end of the mixing process and after previous additions, dispersings and partial dissolvings of the carbonate and bicarbonate. The silicate employed will preferably be of $Na_2O:SiO_2$ ratio within the range of 1:2 to 1:2.6, more preferably 1:2.3 to 1:2.5, and most preferably will be 1:2.35 or 1:2.4, or about such a ratio.

Although it is highly preferred to make the crutcher slurry and the base bead product of this invention (from which a heavy duty built nonionic synthetic organic detergent composition can readily be produced) of essentially inorganic salts, in such manner that they will be of bead properties that promote absorption through the bead surfaces of nonionic detergent sprayed thereon in liquid form, and although the adjuvants, such as perfumes, colorants, enzymes, bleaches and flow promoting agents, may often be sprayed onto the beads with the nonionic detergent or may be post-added, for stable and normally solid adjuvants mixing in with the inorganic salt slurry in the crutcher may be feasible. Thus, it is contemplated that from 0 to as much as 20% of the crutcher slurry may be of suitable adjuvants or diluents (diluents include inorganic salts, such as sodium sulfate and sodium chloride). However, if such materials are present, normally the proportion thereof will be from 0.1 to 10%. Often their total content will be limited to 4%, and sometimes to 1 or 2%.

This invention relates primarily to preventing gelation and setting of crutcher mixes which are essentially composed of sodium bicarbonate, sodium carbonate and sodium silicate, as described, but the benefits of the carbon dioxide, to a lesser extent when the problem is less severe, may also be obtained when insoluble particulate materials, such as hydrated sodium aluminosilicate zeolites, e.g., Zeolite 4A, Zeolite X and Zeolite Y, hydrated with from 5 to 22 percent of water per mol, are employed in a proportion up to 50% of the solids content of the crutcher mix, with the proportions of the sodium bicarbonate, sodium carbonate and sodium silicate being within the ranges previously given (and the percentages thereof being reduced proportionately). Similarly, when pentasodium tripolyphosphate is present at such a proportion of solids content of the crutcher mix or when other polyphosphates are substituted for it, in whole or in part, or when such is/are mixed with zeolite(s), gelation preventions may also results. In such cases, when either the zeolite or polyphosphate or a mixture thereof is present, with the total of zeolite and phosphate not exceeding half the solids content of the crutcher mix, improved fluidity of the mix may result and can be useful. Normally, when zeolite and/or polyphosphate is/are present, the amount thereof will be from 5 to 50% or 10 to 35% of the solids content of the crutcher slurry.

The carbon dioxide employed to prevent premature gelation of the crutcher slurry during addition of silicate solution is preferably in pure or substantially pure gaseous form but under suitable circumstances it may be in other physical states or may be mixed with other materials. For example, while it is preferred to discharge it into the crutcher slurry as a gas, fed from a conventional pressurized cylinder of liquid carbon dioxide or from a pressurized gas line in the manufacturing plant, it is within the invention to employ liquid carbon dioxide or solid carbon dioxide (dry ice) too, both of which forms almost instantaneously are convertible to gas when brought into contact with the crutcher slurry. The various forms of carbon dioxide are easily premeasured or dispensable at known rates by valve adjustments. Thus, solid carbon dioxide may be cut to size or "molded" to size and shape or it may be size reduced to chips, flakes or other particulate forms. Alternatively, it may be weighed out to assure that the correct amount is used. The dispensing of liquid and gaseous carbon dioxide may be regulated by dispensing valve openings and discharge times. If considered desirable, the carbon dioxide may be diluted with air, nitrogen or other suitable gases but normally such dilution is not to less than 10% $CO_2$ by volume, and usually the carbon dioxide will be a major proportion of the gas. While it is considered to be preferable to discharge the carbon dioxide below the surface of the crutcher slurry, especially when it is added as a gas, it is possible to deposit it on the surface of the slurry, allowing it to be drawn into the slurry by the action of the mixer. For example, in some instances it may be convenient to employ small fire extinguisher type dispensers of carbon dioxide and to "spray" the gelation preventing compound onto the surface of the crutcher mix.

In addition to the carbon dioxide there may also be employed, if considered desirable, other anti-gelling materials, such as citric acid, water soluble citrates, mixtures of such citrates and mixtures of citric acid and such citrates, as described in my patent application Ser. No. 081,799. Other anti-gelling materials may also be incorporated but normally none needs to be used other than the carbon dioxide. While the pH of the crutcher slurry of the mentioned constituents can be in the range of 9 to 11 or 12, without the use of any acidic additive, by employing the carbon dioxide and admixing it with the crutcher slurry during (and sometimes also before) addition of the silicate solution, the pH of the slurry is desirably maintained at about 9.9, e.g., 9.7 to 10.1, and is preferably in the range of 9.8 to 10.0. By controlling the addition of carbon dioxide so as to maintain such a pH, any undesirable gelation or setting in the crutcher as the silicate solution is added will be prevented. If citric acid or sodium citrate is present in the crutcher mix the amount employed may be that described in my aforementioned parent patent application, 0.1 to 2%, but often a smaller proportion, such as 0.2 to 0.5% will be more than adequate, due to the use of the carbon dioxide.

The bicarbonate, carbonate and silicate present will be inorganic and almost invariably will be alkali metal salts with the sodium salts being preferred, although some potassium salts, usually up to no more than 25% and preferably no more than 10% of the total salt content, may sometimes be present. The sodium carbonate and sodium bicarbonate and any normally solid adjuvant material which may be with them in the crutcher mix will normally be finely divided before addition to the crutcher, usually being of particle sizes in the range of No's. 60 to 270, preferably 100 to 200, U.S. Sieve Series. However, due to the mixing action of the crutcher and partial dissolvings of water soluble materials, larger sized particles may be employed. Also, if dusting is not a problem, compounds having finer particles can be used. In some instances the sodium silicate employed may be in particulate form, usually to a minor extent, but care should be used to assure that the presence of particulate silicate does not cause gelation despite the employment of carbon dioxide. Preferably, the silicate will all be in aqueous solution, normally being of a concentration in the range of 40 to 50%, preferably 45 to 50% and most preferably, about 47.5%. If conveniently available, solutions of the carbonate and bicarbonate may also be utilized to supply minor proportions of those salts, with some of the slurry water, too.

The water employed may be any suitable deionized and/or distilled water but it has been found feasible to employ ordinary city or tap water, which will normally be of a hardness no more than about 150 parts per million, as calcium carbonate, with such hardness usually being in the range of 50 to 125 p.p.m., as $CaCO_3$. The aqueous medium and the crutcher slurry are preferably at an elevation temperature, usually in the 40° to 70° C. range, so as to promote solutions of the various water soluble salts, portions of which are present in dispersed solid state, too. Preferred temperature range is 40° to 50° C. Heating can sometimes aid in thinning of the slurry and additionally, imparts energy to the slurry so as to facilitate subsequent drying thereof. However heating can sometimes promote gellation, and in such cases excessive heating will be avoided.

The orders of additions of the various components to the crutcher are not considered to be critical, except that a significant proportion of the silicate solution, preferably all of it, will be added to the crutcher slurry last, and if not last, at least after the addition of the carbonate and bicarbonate. It is satisfactory if the carbon dioxide is admixed with the slurry concurrently with the addition of the silicate solution to it but in some instances it may be desirable to add a portion of the carbon dioxide to the slurry before the silicate; when such is done the proportion of the carbon dioxide so added will usually be in the range of 1 to 50%, preferably 5 to 20%. Usually at least 75 or 80% of the carbon dioxide is added to the slurry during the admixing therewith of the sodium silicate solution and preferably such minimum proportion will be 80 or 90% or more.

The crutcher mixing time to obtain a good slurry can vary, usually being from as little as half a minute for small crutchers, usually from 1 to 15 minutes, but when the slurries are of higher moisture contents, may be higher, up to an hour and in some circumstances to as much as four hours. Crutcher mixing times may depend on the drying tower throughput rate and its size, relative to the crutcher size and the number of crutchers employed. However, crutching times will normally be from 1 to 15 minutes, e.g., 10 minutes, and of this time, the silicate solution addition will usually be gradual and will take place over a period of from 5 to 10 minutes, often 7 to b 9 minutes, e.g., 8 minutes, while the H is being maintained as was previously mentioned. Under such conditions the crutcher slurry made is non-gelling, despite the fact that without the addition of carbon dioxide or other satisfactory gelation preventing material the addition of the formula proportion of silicate often causes setting of the crutcher mix, halting production and requiring a difficult cleanout.

The slurries treated by the method of this invention will remain miscible and pumpable for at least 15 minutes after cessation of carbon dioxide addition and normally the period for pumpability will be at least ½ hour after termination of the carbon dioxide treatment. In some instances this time will extend to an hour, two hours or four hours, depending on the circumstances, amount of carbon dioxide employed, crutcher slurry formulation, temperature, solids content and other variables.

The crutched slurry, with inorganic salt particles uniformly distributed therein, in part due to the desirable effects of the addition of the carbon dioxide, is transferred in the usual manner to a spray drying facility, which is usually located adjacent to the crutcher. The slurry is dropped from the crutcher to a positive displacement pump, which forces it at high pressure through spray nozzles in a conventional countercurrent (or concurrent) spray tower, wherein droplets of the slurry fall through hot drying gas (usually fuel oil combustion products) and are dried to desired absorptive bead form. During such drying, due to the high temperatures encountered, part of the bicarbonate is converted to carbonate, with the release of carbon dioxide, which appears to improve the physical characteristics of the beads made, so that they are more absorptive of liquid nonionic detergent to be post-sprayed onto them subsequently.

After drying in the drying gas, which ranges in temperature from about 600° C. down to 100° C. in passage through the tower, the product is screened to desired size, e.g., No's, 10 to 100, U.S. Standard Sieve Series, and is ready for application of nonionic detergent spray thereto, with the beads being either in warm or cooled (to room temperature) condition. The nonionic detergent, applied to the tumbling beads in known manner, is preferably a condensation product of ethylene oxide and higher fatty alcohol, with the higher fatty alcohol being of 10 to 20 carbon atoms, preferably of 12 to 16 carbon atoms, and with the nonionic detergent containing from about 3 to 20 ethylene oxide groups per mol, preferably from 6 to 12. The proportion of nonionic detergent in the final product will usually be from 10 to 25%, such as from 15 to 22%. However, other proportions may also be employed, as desired, depending on the end use of the product. A preferred finished product formulation contains 15 to 22% of the nonionic detergent (e.g., Neodol® 23-6.5, made by Shell Chemical Company), 30 to 40% of sodium bicarbonate, 20 to 30% of sodium carbonate, 5 to 15% of sodium silicate of $Na_2O:SiO_2$ ratio of 1:2.4 and 0.5 to 5 or 10% moisture. Such product may also include, in place of proportionate amounts of the other constituents, about 2% of fluorescent brightener(s), about 1% of proteolytic enzyme(s), sufficient bluing to color the product as desired, usually about 0.01 to 0.1%, and 0.2 to 1% of perfume. The base beads made, devoid of nonionic detergent and adjuvants, will preferably comprise from 35 or 40 to 60% of sodium bicarbonate, 20 or 25 to 45% of sodium carbonate, 10 to 20% of sodium silicate, 0 to 10% of adjuvant(s) and/or diluent(s) and 1 to 10% of moisture. In both the base and finished products the proportion of sodium bicarbonate to sodium carbonate will usually be within the range of 1:1 to 3:1, preferably be within the range of 1.2:1 to 2.4:1.

The exceptionally beneficial result of incorporation of the carbon dioxide in the crutcher slurry in accordance with this invention allows the commercialization of the described product because it facilitates manufacture without the economically disastrous downtimes and cleanups otherwise associated with premature gelation and setting of the crutcher slurry. The mechanism for the setting is not completely understood but it relates to the presence of silicate with the bicarbonate-carbonate mixture, and the influence of the carbon dioxide on their interactions. Although it is conceivable that premature setting of such crutcher mixes could be avoided by modifications of the proportions of bicarbonate, carbonate and silicate, changing of the type of silicate, stringent temperature and mixing controls, and the use of other gelation preventing compounds, such modifications might sometimes affect the properties of the heavy duty detergent to be made or could require impracticable controls. Accordingly, they have been resisted. Also, making such modifications might require the stocking of a variety of additional materials, which could be detrimental to the economy of operation. Instead, with the present invention, at little expense and without detrimental effects on the product, the desired proportions of the builder salts can be employed and reasonable variations in such proportions can be made, as desired, without fear of freeze-ups in the crutcher. Tests of the base beads and of the final product show no adverse effects due to the carbon dioxide addition and both the base beads and final product are of desired bulk densities and flow properties. The carbon dioxide added to the slurry appears to serve as a source of carbonate, the addition of which could otherwise have promoted gelation, whereas the addition of carbon dioxide retards and prevents gelation. It is considered that the carbon dioxide can react with alkali in the crutcher to form bicarbonate and that such compound can be at least partially decomposed to carbonate during spray drying of the crutcher slurry.

The following examples illustrate but do not limit the invention. Unless otherwise indicated, all temperatures are in °C. and all parts are by weight in the examples and throughout the specification.

EXAMPLE 1

285 Parts of city tap water of about 100 p.p.m. hardness, as $CaCO_3$, 260 parts of sodium bicarbonate and 56 parts of soda ash (natural) are mixed together in a mixing vessel, with the temperature being maintained at about 50° C. The salts are of particle sizes in the No's. 100–200 range, U.S. Sieve Series. The additions of the mentioned materials take place over a period of about ten minutes and are in the order given, although the orders of addition of the salts may be varied. To this mixture are added, with stirring, 189 parts of a 47.5% solids content aqueous solution of sodium silicate of $Na_2O:SiO_2$ ratio of 1:2.4, concurrently with about three parts of gaseous carbon dioxide (or enough to maintain the pH at about 9.9), such additions being gradual over a period of about 8 minutes. The gaseous carbon dioxide is obtained from a standard commercial pressurized cylinder of liquid carbon dioxide and the gas is bubbled through the slurry at approximately atmospheric pressure (about 760 millimeters of mercury) but, of course, the pressure is greater than the head of slurry above the gas discharge opening. The initial gas temperature is about 5° C. but additional heating applied maintains the slurry at 50° C. During the addition of the sodium silicate solution, concurrently with the carbon dioxide, the pH of the slurry is checked periodically and is controlled at about 9.9 by regulating the additions of the silicate solution and the carbon dioxide accordingly. Such control is precise enough so that the pH is held in the range of 9.7 to 10.1 at all times when the silicate is being added. The mixer employed maintains the slurry homogeneous and such mixing is assisted by the subsurface addition of the carbon dioxide, whereby local overconcentrations of silicate are avoided. Even when such concentrations may occur the presence of the carbon dioxide assists in preventing objectionable gelation and solidification of the mixture.

After completion of the additions of the silicate solution and carbon dioxide, mixing is continued for another half hour, during which period the slurry is maintained in miscible and pumpable liquid form, and no solidification thereof occurs.

In contrast to the results obtained when the method of the invention is practiced, when the same experiment is repeated under the same conditions except for omission of the addition of carbon dioxide (a control experiment), the crutcher mix solidifies before all of the silicate solution has been added.

When the above described experiment of the invention is repeated, with 20% of the carbon dioxide being first bubbled through the preliminary crutcher slurry, containing water, sodium bicarbonate and sodium carbonate, and with the balance thereof being added concurrently with the sodium silicate solution in the manner previously described, the initial pH of the slurry when the silicate solution is first added is lowered to about 9.9 (from about 10.1), which is considered to be preferable for the prevention of gelation and excess thickening, and the making of the crutcher formulation containing silicate proceeds without any objectionable gelation or solidification of the mix.

When variations in the proportions of the mentioned materials are made, ±10% and ±20%, with the proportions being kept with the ranges set forth in the preceding specification, the mixing also will proceed satisfactorily. Good processing and satisfactory product are also obtainable when the silicate is changed to one of $Na_2O:SiO_2$ ratio of 1:2 or 1:2.6. This is also the case when 10% of the amount of each of the various inorganic salts is replaced by a corresponding potassium salt. Replacement of 65 parts of sodium bicarbonate, 14 parts of sodium carbonate and 47 parts of sodium silicate solution with 101 parts of Zeolite 4A (hydrated to 20%) and 25 parts of water will yield a good crutcher mix which will not gel or set when processed according to the method of this invention. Similarly, no setting will occur when dry ice or liquid $CO_2$ is substituted, preferably only in part, for gaseous carbon dioxide, and is added periodically, with care to maintain the pH in the desired range in the above processes.

The described base beads made are free flowing and are suitable for conversion to built nonionic detergent compositions by addition of polyethoxylated higher fatty alcohol detergent, e.g., Neodol® 23-6.5, to them in liquid state, with the detergent being absorbed by the beads in known manner.

EXAMPLE 2

The procedure of Example 1 is followed but small proportions of desirable adjuvants are incorporated in the crutcher mix after the additions of aqueous silicate solution and gaseous carbon dioxide, the slurry is spray dried to form free flowing base beads and these are then converted to a finished detergent product by absorption therein of nonionic detergent and by blending with other adjuvants. Incorporated in the slurry preferably after addition of the silicate and carbon dioxide, are 2% of aqueous fluorescent brightener solution (about 0.1% of such brightener) and 0.5% of pigment (ultramarine blue), on a final product basis. The making of the crutcher mix proceeds uneventfully, without undesirable gelation, and within a period of 20 minutes, from 10 to 30 minutes after completion of the addition of the slurry components, the slurry is dropped from the crutcher and spray dried to base bead form. After being dropped, the slurry is pumped at a pressure of about 35 kilograms per square centimeter through conventional spray nozzles, having orifices about 1 mm. in diameter, into heated drying air (products of combustion of fuel oil) in a countercurrent spray drying tower in which the drying air inlet temperature is about 425° C. and the outlet temperature is about 105° C. The dried beads resulting are screened to be within a desired range of No's. 10 to 100, U.S. Sieve Series sizes. They have a moisture content in the range of 1 to 10%, normally being about 3 to 5%. They are free flowing and of a bulk density in the range of 0.5 to 0.9 gram per milliliter. Subsequently, sufficient nonionic detergent (Neodol® 23-6.5) in liquid form, at a temperature of about 50° C., is sprayed onto the base beads to make a product containing about 20% of the nonionic detergent, 35% of sodium bicarbonate, 25% of sodium carbonate, 10% sodium silicate, 2% of moisture and the balance of adjuvants. If desired, about 0.5% of proteolytic enzyme, such as Maxatase®, may be blended with the finished product to assist in its heavy duty cleaning activity against stains and soils which are subject to enzymatic attack.

The product resulting is an excellent heavy duty laundry detergent of the controlled foam type. It is free flowing by the tests normally employed, having a flow rate greater than 70% of that of equivalently sized dry sand (see U.S. patent application Ser. No. 964,037, filed Dec. 21, 1978, for a description of the method for determining flowability). Its bulk density is about 0.7 g./ml., within a desired range of 0.6 to 0.9 g./ml.

The invention has been described with respect to various illustrative examples and embodiments thereof but is not to be limited to these because it is evident that one of skill in the art, with the present teaching before him, will be able to utilize substitutes and equivalents without departing from the invention.

What is claimed is:

1. A method of retarding or preventing the gelation of a miscible and pumpable crutcher slurry containing from 40 to 70% of solids and 60 to 30% of water, of which solids content, on a 100% solids basis, 40 to 80% is sodium bicarbonate, 5 to 40% is sodium carbonate and 5 to 25% is sodium silicate of $Na_2O:SiO_2$ ratio within the range of 1:1.6 to 1:3, with the ratio of sodium bicarbonate:sodium carbonate being within the range of 2:1 to 8:1 and the ratio of sodium carbonate:sodium silicate being within the range of 1:3 to 3:1, which comprises preparing an aqueous crutcher slurry of the sodium bicarbonate and sodium carbonate, and admixing with such aqueous slurry carbon dioxide and an aqueous solution of the sodium silicate, said carbon dioxide being added in an amount sufficient to prevent said gelation of the slurry.

2. A method according to claim 1 wherein the crutcher slurry contains from 50 to 65% of solids and 50 to 35% of water, of which solids content 50 to 80% is sodium bicarbonate, 10 to 20% is sodium carbonate and 10 to 25% is sodium silicate of $Na_2O:SiO_2$ ratio within the range of 1:2 to 1:2.6, the ratio of sodium bicarbonate:sodium carbonate is within the range of 3:1 to 6:1 and the ratio of sodium carbonate:sodium silicate is within the range of 2:5 to 5:2 and wherein the addition of the carbon dioxide to the slurry is such as to maintain the pH of the slurry within the range of 9.7 to 10.1 during the addition of the sodium silicate solution.

3. A method according to claim 2 wherein the crutcher slurry is at a temperature in the range of 40° to 70° C. and at atmospheric pressure, the sodium silicate solution is from 40 to 50% solids, and from 1 to 50% of the carbon dioxide mixed with the slurry is mixed with it before admixing therewith of the sodium silicate solution.

4. A method according to claim 3 wherein the crutcher slurry contains from 50 to 60% of solids and 50 to 40% of water, of which solids content 60 to 75% is sodium bicarbonate, 10 to 20% is sodium carbonate and 10 to 25% is sodium silicate of $Na_2O:SiO_2$ ratio of about 1:2.4, the ratio of sodium bicarbonate:sodium carbonate is within the range of 4:1 to 5:1 and the ratio of sodium carbonate:sodium silicate is within the range of 1:1 to 1:2, and wherein the percentage of carbon dioxide added to the crutcher slurry is from 0.1 to 2% and at least 75% of such carbon dioxide is added to the slurry during the admixing of the sodium silicate solution, which admixing takes place over a period of from 2 to 10 minutes, with the rates of addition of sodium silicate solution and carbon dioxide being such as to maintain the pH of the crutcher mix in the range of 9.8 to 10 during admixing.

5. A method according to claim 1 wherein mixing is at an elevated temperature, in the range of 40° to 70° C., and is continued for at least fifteen minutes after completion of the making of the crutcher slurry to which the carbon dioxide had been added in gaseous form.

6. A method according to claim 4 wherein the crutcher slurry temperature is in the range of 40° to 50°

C., the mixing is continued for a period of at least a half hour after completion of the making of the crutcher slurry, and the slurry is pumped out of the crutcher to a spray drying tower and is spray dried therein.

7. A method according to claim 1 wherein the carbon dioxide that is employed is from a pressurized source of gaseous carbon dioxide.

8. A method according to claim 4 wherein the carbon dioxide that is employed is from a pressurized cylinder of liquid carbon dioxide.

9. A method according to claim 1 wherein at least some gaseous carbon dioxide that is employed is produced in situ in the crutcher slurry by admixing therewith of solid carbon dioxide, which is then heated by the slurry and thereby is converted to the gaseous state.

10. A method according to claim 1 wherein the percentage of carbon dioxide added to the crutcher slurry is such as to maintain the pH of the slurry in the 9.7 to 10.1 range.

11. A method according to claim 10 wherein the sodium silicate solution is from 40 to 50% solids, the addition of the sodium silicate solution takes from 1 to 15 minutes, at least 75% of the carbon dioxide is added to the slurry during the addition of the sodium silicate solution, and the rates of addition of such solution and the carbon dioxide are maintained so as to keep the pH of the crutcher mix about 9.9.

12. A method of making a particulate base material in bead form, suitable for absorbing nonionic detergent to make a built heavy duty synthetic organic detergent composition, which comprises making a miscible and pumpable crutcher slurry containing from 40 to 70% of solids and 60 to 30% of water, of which solids content, on a 100% solids basis, 40 to 80% is sodium bicarbonate, 5 to 40% is sodium carbonate and 5 to 25% is sodium silicate of $Na_2O:SiO_2$ ratio within the range of 1:1.6 to 1:3, with the ratio of sodium bicarbonate:sodium carbonate being within the range of 2:1 to 8:1 and the ratio of sodium carbonate:sodium silicate being within the range of 1:3 to 3:1, by preparing in a crutcher a slurry of the sodium bicarbonate and sodium carbonate in water, admixing with such slurry an aqueous solution of the sodium silicate and admixing carbon dioxide with the slurry during the admixing of the sodium silicate solution, so as to maintain the pH of the slurry within the range of 9.7 to 10.1 during the addition of the sodium silicate solution and thereby prevent gelation of said slurry, pumping the slurry out of the crutcher in ungelled and readily pumpable state and spray drying the slurry to particulate bead form, during which spray drying a portion of the sodium bicarbonate is converted to sodium carbonate.

* * * * *